US007696968B2

(12) United States Patent
Huang et al.

(10) Patent No.: US 7,696,968 B2
(45) Date of Patent: Apr. 13, 2010

(54) LIQUID CRYSTAL DISPLAY APPARATUS WITH COLOR SEQUENTIAL DISPLAY AND METHOD OF DRIVING THE SAME

(75) Inventors: Hsueh Ying Huang, Hsin-Chu (TW); Ming-Sheng Lai, Hsin-Chu (TW)

(73) Assignee: Au Optronics Corporation, Hsinchu (TW)

( * ) Notice: Subject to any disclaimer, the term of this patent is extended or adjusted under 35 U.S.C. 154(b) by 758 days.

(21) Appl. No.: 11/646,086

(22) Filed: Dec. 27, 2006

(65) Prior Publication Data

US 2008/0158240 A1 Jul. 3, 2008

(51) Int. Cl.
*G09G 3/36* (2006.01)

(52) U.S. Cl. ..... 345/89; 345/690

(58) Field of Classification Search ..... 345/87, 345/89, 690–693
See application file for complete search history.

(56) References Cited

U.S. PATENT DOCUMENTS 5,233,338 A 8/1993 Surguy
6,836,232 B2 12/2004 Bu
6,879,310 B2 4/2005 Nose
7,364,306 B2 * 4/2008 Margulis ..... 353/31
2005/0225545 A1 10/2005 Takatori et al.
2005/0237288 A1 * 10/2005 Yoshinaga et al. ..... 345/88
2006/0028424 A1 2/2006 Wu et al.

* cited by examiner

*Primary Examiner*—Ricardo L Osorio
(74) *Attorney, Agent, or Firm*—Morris, Manning & Martin LLP; Tim Tingkang Xia

(57) ABSTRACT

A method of gamma correction for a liquid crystal display (LCD) having an LCD panel. In one embodiment, the method includes the steps of dividing the LCD panel into N areas along a gate scanning direction, each area having a corresponding gamma and being characterized with a corresponding voltage-transmittance function, and determining grey level voltages of each area for each of a set of grey levels from the corresponding voltage-transmittance function of the area and a desired gamma curve of the LCD panel such that when the grey level voltages are respectively applied to the N areas for a grey level, a light transmittance through each area is substantially uniform and equals to a corresponding brightness.

39 Claims, 9 Drawing Sheets

(A)

(B)

(B)

(A)

(A)

(B)

LIQUID CRYSTAL DISPLAY APPARATUS WITH COLOR SEQUENTIAL DISPLAY AND METHOD OF DRIVING THE SAME

FIELD OF THE INVENTION

The present invention relates generally to a liquid crystal display (LCD), and more particularly to methods of gamma correction for an LCD with color-sequential display and applications of the same.

BACKGROUND OF THE INVENTION

Liquid crystal display (LCD) is commonly used as a display device because of its capability of displaying images with good quality while using little power. An LCD device includes an LCD panel formed with liquid crystal cells and pixels associating with the liquid crystal cells. These pixels are substantially arranged in the form of a matrix having a number of pixel rows and a number of pixel columns. Gate signals and data signals are respectively applied to the pixel rows and the pixel columns to align states of the liquid crystals to control light transmission through the pixels for the entire LCD panel so as to display frames through the input of image data of respective pixels. Since the pixels can only display the grey level from brightness to darkness, other means are needed for the display of colors.

Referring to FIG. 7, a conventional LCD 700 displays colors through color filters that display the three primary color components of a pixel at the same time. Each pixel of the color filter LCD panel 710 includes three displaying units respectively corresponding to a red filter 722, a green filter 724 and a blue filter 726. The red light 732, green light 734 and blue light 736 displayed respectively via the filters 722, 724 and 726 are combined and the colors of the pixel are perceived by the viewer. However, the use of color filters for color display in LCD panels not only increases the manufacturing cost of LCDs, but also reduces the light transmission therethrough.

FIG. 8 shows a conventional color-sequential LCD 800 that displays colors by sequentially displaying the components of the three primary colors 832, 834 and 836 of a pixel. The color-sequential LCD 800 includes a backlight unit capable of emitting, for example, red light 822, green light 824 and blue light 826 respectively from three light sources for each pixel 850. During a frame time, the pixel sequentially displays three sub-frames 832, 834, and 836 of data and the red light, green light and blue light sources are sequentially turned on. Through the persistence of vision, a viewer is able to recognize the color of a pixel.

Compared with the color filter LCDs, a color-sequential LCD displays colors without using color filters, and therefore is advantageous in cost saving and light transmission. Additionally, the color-sequential LCD displays the color of a pixel using only one pixel, thereby increasing the resolution of the LCD by three times. However, for such a color-sequential LCD, image data is input to a pixel sequentially in three times in order to completely input the image data to the pixel, thereby requiring the liquid crystals with much shorter response time. For example, in a color filter LCD, if an image is refreshed at 60 Hz, it makes the time period of one frame about 16.7 ms. Since an image for one color must be displayed within a ⅓ period of 16.7 ms for one frame, the time period used for display a sub-frame of an image is about 5.56 ms in a color-sequential LCD. Therefore, liquid crystals in the color-sequential LCD itself are required to have a response time shorter than 5.56 ms.

Referring to FIG. 9A, an LCD device 900 having an LCD panel 910 having gates A, B and C is shown. When gate signals 922, 924 and 926 generated from a gate driver 920 are sequentially applied to gates A, B and C, respectively, gate C is activated at very last, and therefore, the liquid crystals associated with gate C are driven by data signals 952 and 954 generated from a data driver 950 at very last as well. Ideally, a corresponding backlight is turned on after the liquid crystals associated with all gates including gate C are aligned in their predetermined state in accordance with the data signals 952 and 954. In practice, due to the response time not short enough, the liquid crystals associated with gate C may not be fully aligned when the backlight is turned on, thereby causing non-uniform brightness from the top to the bottom of the LCD panel. As shown in FIG. 9B, for the gate A, the response of the corresponding liquid crystals completes at time $t_1$, while the corresponding liquid crystals of the gate C fully respond at time $t_3$. The backlight, such as light emitting diodes (LEDs), is turned on and off at times $t_2$ and $t_4$. The luminance through the gates A and C in the first scan period are respectively corresponding to areas 991 and 993, which are substantially different.

FIGS. 10A and 10B show the gamma curves for a conventional display panel and a conventional color-sequential LCD panel, respectively. As shown in FIG. 10A, the conventional display panel has a single gamma curve 1010 over the entire panel such that the light transmittance (brightness) through the entire display panel is uniform for a given grey level. However, for a color-sequential LCD panel, different areas of the LCD panel have different gammas. As shown in FIG. 10B, areas A, B and C have gamma curves 1052, 1054 and 1056, respectively. For a given grey level, for example, $L_0$, the light transmittance through the areas A, B and C are $T_a$, $T_b$ and $T_c$, respectively, where $T_a>T_b>T_c$. Therefore, the brightness is non-uniform over the LCD panel.

Therefore, a heretofore unaddressed need exists in the art to address the aforementioned deficiencies and inadequacies.

SUMMARY OF THE INVENTION

The present invention, in one aspect, relates to a method of gamma correction for an LCD with color-sequential display, where the LCD comprises an LCD panel having a plurality of gate lines, a plurality of data lines, and a plurality of pixels spatially arranged in a matrix, each pixel being defined between two neighboring gate lines and two neighboring data lines crossing the two neighboring gate lines, and being capable of displaying n bits of image data.

In one embodiment, the method comprises the step of dividing the LCD panel along a gate scanning direction into N areas, $\{A_j\}$, j=1, 2, 3, . . . , N, N being an integer greater than one, where each area $A_j$ is characterized with a corresponding light transmittance, $T_j$, which is a function of a voltage $V_j$ applied to the area $A_j$, $T_j=F_j(V_j)$. Each area $A_j$ of the LCD panel is also characterized with a gamma curve, $Gamma_j$, which is corresponding to the voltage-transmittance function $T_j=F_j(V_j)$ of the area $A_j$. The voltage-transmittance functions, $\{T_j=F_j(V_j)\}$, j=1, 2, . . . , N, are identical or different from each other. The difference between the voltage-transmittance functions of different areas relates to at least one of the difference between the response times of liquid crystals associated with different areas, and the difference between scanning times at different gate lines.

The method further comprises the steps of selecting a desired gamma curve; and determining grey level voltages, $V_{j0}, V_{j1}, \ldots, V_{jL}, \ldots$ of each area $A_j$ for each of a set of grey levels, {L}, L=0, 1, 2, . . . , $(2^n-1)$, from the corresponding function $T_j=F_j(V_j)$ and the desired gamma curve such that when the grey level voltages $V_{1L}$, $V_{2L}$, . . . , and $V_{NL}$ are respectively applied to the N areas $\{A_j\}$ for a grey level, L, a light transmittance through each area $A_j$ is substantially uniform and equal to a corresponding brightness, $B_L$. In one embodiment, the desired gamma curve is selected as one of $Gamma_1$, $Gamma_2$, . . . , and $Gamma_N$.

The method also comprises the step of setting up a lookup table (LUT) from the voltage-transmittance function $T_j=F_j(V_j)$ of each areas $A_j$ and the desired gamma curve, where the LUT comprises the set of grey levels, {L}, each grey level L being associated with a brightness, $B_L$, determined by the desired gamma curve at the grey level L, and N grey level voltages $V_{1L}$, $V_{2L}$, . . . , and $V_{NL}$ to be applied to the N areas $A_1$, $A_2$, . . . , and $A_N$, respectively. Each grey level voltage $V_{jL}$ satisfies the relation of $B_L=F_j(V_{jL})$, j=1, 2, . . . , N, and L=0, 1, . . . , $(2^n-1)$. Additionally, the method may comprise the step of mapping grey levels of each frame of an image onto the pixel matrix of the LCD panel such that a grey level associated with a pixel is corresponding to the shade of grey of the frame to be displayed at the pixel. In one embodiment, the step of determining grey level voltages comprises the step of looking up the LUT to determine grey level voltages, in accordance with the mapped grey level at each pixel for a frame of the image. Moreover, the method comprises the steps of sequentially scanning each of the plurality of gate lines to activate pixels associated with the scanned gate line for each frame of the image; and driving the activated pixels with grey level voltages corresponding to grey levels of the frame of the image to be displayed at the activated pixels through the plurality of data lines.

In another aspect, the present invention relates to an LCD with color-sequential display. In one embodiment, the LCD has an LCD panel having a plurality of gate lines, a plurality of data lines, and a plurality of pixels spatially arranged in a matrix, each pixel being defined between two neighboring gate lines and two neighboring data lines crossing the two neighboring gate lines, and being capable of displaying n bits of image data, where the LCD panel is divided along a gate scanning direction into N areas, $\{A_j\}$, j=1, 2, . . . , N, N being an integer greater than one, and where each area $A_j$ is characterized with a corresponding light transmittance, $T_j$, which is a function of a voltage $V_j$ applied to the area $A_j$, $T_j=F_j(V_j)$, and a gamma curve, $Gamma_j$, which is corresponding to the voltage-transmittance function $T_j=F_j(V_j)$ of the area $A_j$. The voltage-transmittance functions, $\{T_j=F_j(V_j)\}$, j=1, 2, . . . , N, are identical or different from each other. The difference between the voltage-transmittance functions of different areas relates to at least one of the difference between the response times of liquid crystals associated with different areas, and the difference between scanning times at different gate lines. In one embodiment, each area $A_j$ includes at least one of the plurality of gate lines and is in communication with the plurality of data lines. In another embodiment, each area $A_j$ of the LCD panel is substantially an area defined between two neighboring gate lines.

The LCD further has a controller programmed to determine grey level voltages, $V_{j0}$, $V_{j1}$, . . . , $V_{jL}$, . . . of each area $A_j$ for each of a set of grey levels, {L}, L=0, 1, 2, . . . , $(2^n-1)$, from the corresponding function $T_j=F_j(V_j)$ and a desired gamma curve such that when the grey level voltages $V_{1L}$, $V_{2L}$, . . . , and $V_{NL}$ are respectively applied to the N areas $\{A_j\}$ for a grey level, L, a light transmittance through each area $A_j$ is substantially uniform and equal to a corresponding brightness, $B_L$. In one embodiment, the desired gamma curve of the LCD panel is one of $Gamma_1$, $Gamma_2$, . . . , and $Gamma_N$.

The LCD also has means for setting up a lookup table (LUT) from the voltage-transmittance function $T_j=F_j(V_j)$ of each areas $A_j$ and the desired gamma of the LCD panel. In one embodiment, the LUT comprises the set of grey levels {L}, each grey level L being associated with a brightness, $B_L$, determined by the desired gamma of the LCD panel at the grey level L, and N grey level voltages $V_{1L}$, $V_{2L}$, . . . , and $V_{NL}$ to be applied to the N areas $A_1$, $A_2$, . . . , and $A_N$, respectively, where each grey level voltage $V_{jL}$ satisfies the relation of $B_L=F_j(V_{jL})$, j=1, 2, 3, . . . , N, and L=0, 1, 2, . . . , $(2^n-1)$.

Furthermore, the LCD has means for mapping grey levels of each frame of an image onto the pixel matrix of the LCD panel such that a grey level associated with a pixel is corresponding to the shade of grey of the frame of an image to be displayed at the pixel; and means for looking up the LUT to determine grey level voltages, each driving a corresponding pixel of the LCD panel, in accordance with the mapped grey level at each pixel for a frame of the image.

Additionally, the LCD has a gate driver for generating scanning signals sequentially applied to each of the plurality of gate lines to activate pixels associated with the scanned gate line for each frame of the image; and a data driver coupling to the looking up means for grey level voltages corresponding to grey levels of the frame of the image to be displayed at the activated pixels to drive the activated pixels through the plurality of data lines.

In yet another aspect, the present invention relates to a method of gamma correction for an LCD with color-sequential display, where the LCD comprises an LCD panel having a plurality of gate lines, a plurality of data lines, and a plurality of pixels arranged in a matrix, each pixel being capable of displaying n bits of image data. In one embodiment, the method includes the step of dividing the LCD panel along a gate scanning direction into N areas, $\{A_j\}$, j=1, 2, . . . , N, N being an integer greater than one, where each area $A_j$ has at least two area units, $U_{j1}$ and $U_{j2}$, and is characterized with a gamma curve, $Gamma_j$, which is corresponding to a voltage-transmittance function, $T_j=F_j(V_j)$, and where $V_j$ is a voltage applied to the area $A_j$, $T_j$ is a light transmittance through the area $A_j$, and $F_j(V_j)$ is a function of the applied voltage $V_j$. In one embodiment, each area $A_j$ includes at least one of the plurality of gate lines and is in communication with the plurality of data lines. In another embodiment, each area $A_j$ is substantially an area defined between two neighboring gate lines. Each area unit of an area $A_j$ is substantially coincident with a pixel of the area $A_j$, where the pixel is defined between two neighboring gate lines and two neighboring data lines crossing the two neighboring gate lines.

Furthermore, the method includes the step of determining a first set of grey level voltages, $\{V_L\}$, for area $A_1$, corresponding to a set of grey levels, {L}, L=0, 1, . . . , $(2^n-1)$, from the voltage-transmittance function $T_1=F_1(V_1)$ of the area $A_1$ and a gamma curve, $Gamma_1$, of the area $A_1$, where each grey level L is associated with one of shades of grey of a frame of an image to be displayed at a pixel of the LCD panel.

Moreover, the method includes the step of determining a second set of grey level voltages, $\{V_{jL}\}$, for each area $A_j$, corresponding to the set of grey levels {L} from the corresponding voltage-transmittance function $T_j=F_j(V_j)$ and a desired gamma curve such that when the second set of grey level voltages $V_{1L}$, $V_{2L}$, . . . , and $V_{NL}$ are respectively applied to the N areas $\{A_j\}$ for a grey level, L, a light transmittance through each area A is substantially uniform and equal to a corresponding brightness, $B_L$.

Additionally, the method includes the step of driving the area unit $U_{j1}$ of each area $A_j$ with grey level voltages selected from the first set of grey level voltages $\{V_L\}$ corresponding to grey levels of a frame of an image to be displayed at the area unit $U_{j1}$ of each area $A_j$ through data lines associated with the area unit $U_{j1}$ of each area $A_j$, and the area unit $U_{j2}$ of each area $A_j$ with grey level voltages selected from the second set of grey level voltages $\{V_{jL}\}$ corresponding to grey levels of the frame of the image to be displayed at the area unit $U_{j2}$ of each area $A_j$ through data lines associated with the area unit $U_{j2}$ of each area $A_j$, respectively.

The method may further comprise the step of mapping grey levels of each frame of an image onto the pixel matrix of the LCD panel such that a grey level associated with a pixel is corresponding to the shade of grey of the frame to be displayed at the pixel.

In a further aspect, the present invention relates to a method of gamma correction for a liquid crystal display (LCD) with color-sequential display, where the LCD comprises an LCD panel formed with a plurality of gate lines spatially arranged along a gate scanning direction, a plurality of data lines spatially arranged along a direction substantially perpendicular to the gate scanning direction, and a plurality of pixels arranged in a matrix, each pixel being capable of displaying n bits of image data.

In one embodiment, the method includes the step of dividing the LCD panel along the gate scanning direction into N areas, $\{A_j\}$, j=1, 2, . . . , N, each area $A_j$ having M area units $\{U_{jk}\}$, k=1, 2, . . . , M, where each area, $A_j$, is characterized with a gamma curve, $Gamma_j$, which is corresponding to a voltage-transmittance function, $T_j=F_j(V_j)$, and where $V_j$ is a voltage applied to the area $A_j$, $T_j$ is a light transmittance through the area $A_j$, and $F_j(V_j)$ is a function of the applied voltage $V_j$. Each area $A_j$ of the LCD panel includes at least one of the plurality of gate lines and is in communication with the plurality of data lines. Each area $A_j$ of the LCD panel may be substantially an area defined between two neighboring gate lines. In one embodiment, each area unit $U_{jk}$ of an area $A_j$ of the LCD panel is substantially coincident with a pixel of the area $A_j$, where the pixel is defined between two neighboring gate lines and two neighboring data lines crossing the two neighboring gate lines.

The method further includes the step of determining a first set of grey level voltages, $\{V_L\}$, for area $A_1$, corresponding to a set of grey levels, $\{L\}$, L=0, 1, . . . , $(2^n-1)$, from the voltage-transmittance function $T_1=F_1(V_1)$ of the area $A_1$ and a gamma curve, $Gamma_1$, of the area $A_1$, where each grey level L is associated with one of shades of grey of a frame of an image to be displayed at a pixel of the LCD panel.

The method also includes the step of determining a second set of grey level voltages $\{V_{jL}\}$, for each area $A_j$, corresponding to the set of grey levels $\{L\}$ from the corresponding voltage-transmittance function $T_j=F_j(V)$ of each area $A_j$ and a desired gamma curve such that when the grey level voltages $V_{1L}, V_{2L}, \ldots$, and $V_{NL}$ are respectively applied to the N areas $\{A_j\}$ for a grey level L, a light transmittance through each area $A_j$ is substantially uniform and equal to a corresponding brightness, $B_L$.

Additionally, the method includes the steps of driving each one of the area units $\{U_{jk}\}$ with grey level voltages selected from the first set of grey level voltages $\{V_L\}$ corresponding to grey levels of an m-th frame of an image to be displayed at the one of the area units $\{U_{jk}\}$ through data lines associated with the one of the area units $\{U_{jk}\}$, where m=1, 2, . . . , P, P being an integer greater than one and a number of frame of the image; and driving each one of the area units $\{U_{jk}\}$ with grey level voltages selected from the second set of grey level voltages $\{V_{jL}\}$ corresponding to grey levels of an (m+1)-th frame of the image to be displayed at the one of the area units $\{U_{jk}\}$ through data lines associated with the one of the area units $\{U_{jk}\}$.

The method may also includes the step of mapping grey levels of each frame of the image onto the pixel matrix of the LCD panel such that a grey level associated with a pixel is corresponding to the shade of grey of the frame to be displayed at the pixel.

In one embodiment, the grey level voltages driving each one of the area units $\{U_{jk}\}$ for the m-th frame of the image have an opposite bias to the grey level voltages driving the one of the area units $\{U_{jk}\}$ for the (m+1)-th frame of the image.

In yet a further aspect, the present invention relates to a method of gamma correction for an LCD with color-sequential display, where the LCD comprises an LCD panel formed with a plurality of gate lines spatially arranged along a gate scanning direction, a plurality of data lines spatially arranged along a direction substantially perpendicular to the gate scanning direction, and a plurality of pixels arranged in a matrix, each pixel being capable of displaying n bits of image data. In one embodiment, the method comprises the steps of (a) dividing the LCD panel along the gate scanning direction into N areas, $\{A_j\}$, j=1, 2, . . . , N, each area $A_j$ having M area units $\{U_{jk}\}$, k=1, 2, . . . , M, where each area, $A_j$, is characterized with a gamma curve, $Gamma_j$, which is corresponding to a voltage-transmittance function, $T_j=F_j(V_j)$, and where $V_j$ is a voltage applied to the area $A_j$, $T_j$ is a light transmittance through the area $A_j$, and $F_j(V_j)$ is a function of the applied voltage $V_j$; (b) determining a first set of grey level voltages, $\{V_L\}$, for area $A_1$, corresponding to a set of grey levels, $\{L\}$, L=0, 1, . . . , $(2^n-1)$, from the voltage-transmittance function $T_1=F_1(V_L)$ of the area $A_1$ and a gamma curve, $Gamma_1$, of the area $A_1$, where each grey level L is associated with one of shades of grey of a frame of an image to be displayed at a pixel of the LCD panel; (c) determining a second set of grey level voltages $\{V_{jL}\}$, for each area $A_j$, corresponding to the set of grey levels $\{L\}$ from the corresponding voltage-transmittance function $T_j=F_j(V_j)$ of each area $A_j$ and a desired gamma curve such that when the grey level voltages $V_{1L}, V_{2L}, \ldots$, and $V_{NL}$ are respectively applied to the N areas $\{A_j\}$ for a grey level, L, a light transmittance through each area $A_j$ is substantially uniform and equal to a corresponding brightness, $B_L$; (d) driving the area unit $U_{j1}$ of each area $A_j$ with grey level voltages selected from the first set of grey level voltages $\{V_L\}$ corresponding to grey levels of an m-th frame of an image to be displayed at the area unit $U_{j1}$ of each area $A_j$ through data lines associated with the area unit $U_{j1}$ of each area $A_j$, and the area units $U_{j2}, U_{j3}, \ldots$, and $U_{jM}$ of each area $A_j$ with grey level voltages selected from the second set of grey level voltages $\{V_{jL}\}$ corresponding to grey levels of the m-th frame of the image to be displayed at the area units $U_{j2}, U_{j3}, \ldots$, and $U_{jM}$ of each area $A_j$ through data lines associated with the area units $U_{j2}, U_{j3}, \ldots$, and $U_{jM}$ of each area $A_j$, respectively, where m=1, 2, . . . , P, P being an integer greater than one and a number of frame of the image; and (e) driving the area unit $U_{j1}$ of each area $A_j$ with grey level voltages selected from the second set of grey level voltages $\{V_{jL}\}$ corresponding to grey levels of an (m+1)-th frame of the image to be displayed at the area unit $U_{j1}$ of each area $A_j$ through data lines associated with the area unit $U_{jM}$ of each area $A_j$, and the area units $U_{j2}, U_{j3}, \ldots$, and $U_{jM}$ of each area $A_j$ with grey level voltages selected from the first set of grey level voltages $\{V_L\}$ corresponding to grey levels of the (m+1)-th frame of the image to be displayed at the area units $U_{j2}, U_{j3}, \ldots$, and $U_{jM}$ of each area $A_j$ through data lines associated with the area units $U_{j2}, U_{j3}, \ldots$, and $U_{jM}$ of each area $A_j$, respectively.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
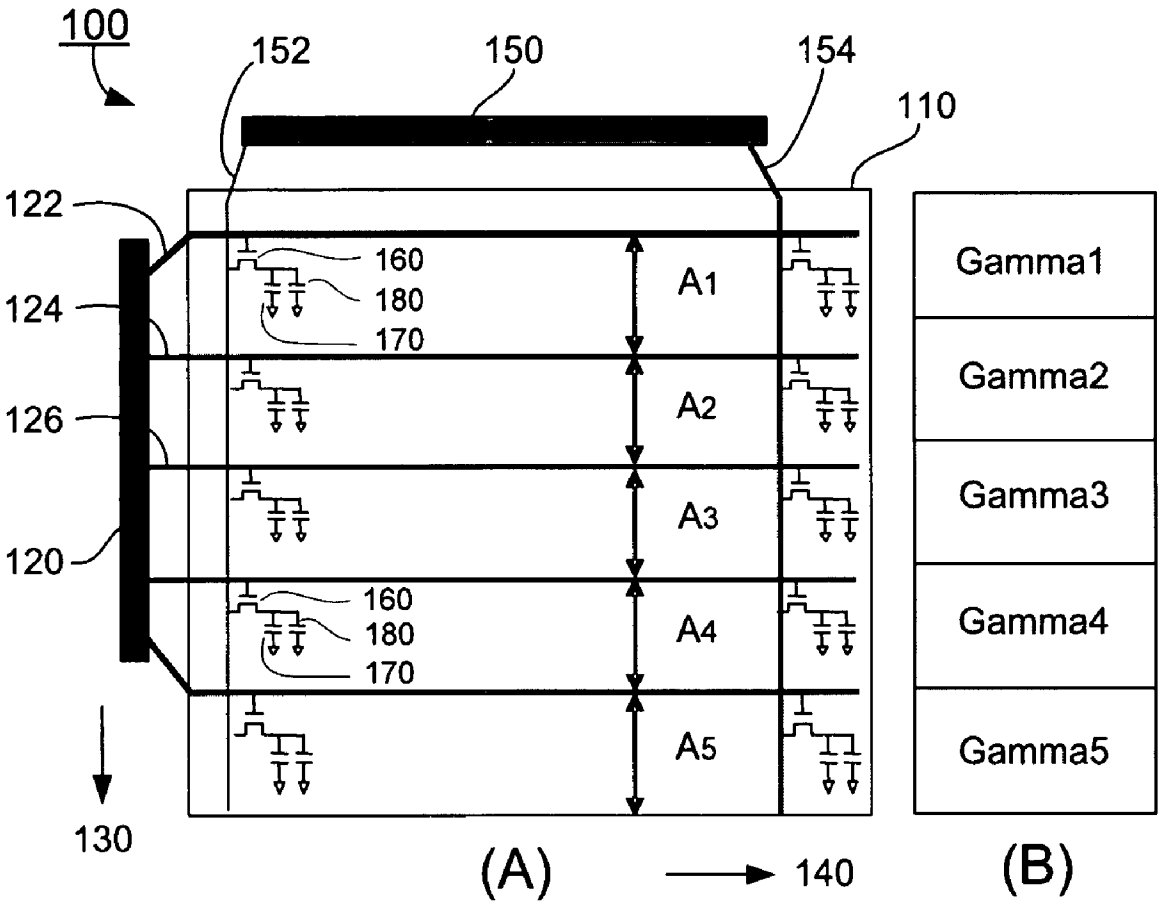
FIG. 1 partially shows schematically an LCD device according to one embodiment of the present invention: (A) a schematic of an LCD panel of the LCD device, having a plurality of areas, and (B) a chart of gammas for different areas of the LCD panel.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Additionally, some terms used in this specification are more specifically defined below.

As used herein, the terms "gamma" and/or "gamma curve" refer to the characterization of brightness of an imaging display system, for example, an LCD device, versus grey levels (scales). Gamma summarizes, in a single numerical parameter, the nonlinear relationship between grey level and brightness of the imaging display system.

As used herein, the terms "grey level" and "grey scale" are synonym in the specification and refer to one of (discrete) shades of grey for an image, or an amount of light perceived by a human for the image. If the brightness of the image is expressed in the form of shades of grey in n bits, n being an integer greater than zero, the grey level takes values from zero representing black, up to $(2^n-1)$ representing white, with intermediate values representing increasingly light shades of grey. In an LCD device, the amount of light that transmits through liquid crystals is adjusted to represent the gray level.

As used herein, the term "grey level voltage" or "driving voltage" refers to a voltage generated from a data driver in accordance for driving a particular area or pixel of an LCD panel, in accordance with a grey level of a frame of an image to be displayed at the particular area or pixel of the LCD panel.

The terms "light transmittance/transmission", "brightness" and "luminance", as used herein, are synonym in the specification and refer to the amount of light that passes through a particular area of an LCD panel.

It has been known that at different grey levels, liquid crystals have different response times in a color sequential LCD panel. For example, liquid crystals usually have the shortest response time at the grey level 255, for 8-bit data signals for example, compared to that at other grey levels. The difference between the response times at different grey levels may result in deviations of the gamma curves for different grey levels at different areas of the LCD panel. Additionally, the larger the size of a LCD panel and/or the higher the resolution of the LCD panel is, the longer the time difference between scanning the top gate line and the bottom gate line becomes. As a result, the liquid crystals associated with the top gate line may complete their response to driving signals, while the liquid crystals associated with the bottom gate line may not, in a given period of time, for example, a time period of frame, thereby causing the brightness at the top portion of the LCD panel to be brighter than that at the bottom portion of the LCD panel.

Therefore, one aspect of the present invention provides methods to overcome the drawbacks of a color sequential LCD device.

The description will be made as to the embodiments of the present invention in conjunction with the accompanying drawings. In accordance with the purposes of this invention, as embodied and broadly described herein, this invention, in one aspect, relates to a method of gamma correction for an LCD device with color-sequential display. The LCD device comprises an LCD panel formed with a plurality of gate lines to which scanning signals are sequentially applied and a plurality of data lines to which data signals are applied.

Referring to FIG. 1, an LCD device 100 is partially and schematically shown according to one embodiment of the present invention, which has an LCD panel 110, a gate driver 120 and a data driver 150. The LCD panel 110 has a plurality of gate lines 122, 124, . . . , and a plurality of data lines 152, 154, . . . . The plurality of gate lines 122, 124, . . . are spatially arranged along a gate scanning direction 130. The plurality of data lines 152, 154, . . . are spatially arranged crossing plurality of gate lines 122, 124, . . . , along a direction 140 substantially perpendicular to the gate scanning direction 130. Furthermore, the LCD panel 110 has a plurality of pixels spatially arranged in a matrix, where each pixel is defined between two neighboring gate lines of the plurality of gate lines 122, 124, . . . and two neighboring data lines of the plurality of data lines 152, 154, . . . crossing the two neighboring gate lines of the plurality of gate lines 122, 124, . . . . Each pixel has a thin film transistor (TFT) 160 with its gate electrode being connected to a corresponding gate line, its source/drain electrodes being connected to a corresponding data line and its drain/source electrodes being connected to a liquid crystal capacitor 170 and a storage capacitor 180, respectively. Each pixel is capable of displaying n bits of image data.

The gate driver 120 is electrically coupled with the plurality of gate lines 122, 124, . . . for generating scanning signals that are sequentially applied to the plurality of gate lines 122, 124, . . . . The data driver 150 is electrically coupled with the plurality of data lines 152, 154, . . . for generating data signals, in accordance with an image to be displayed. When a scanning signal is applied to a gate line to turn on the corresponding TFT 160 connected to the gate line, the generated data signals are simultaneously applied to the plurality of data lines 152, 154, . . . so as to charge the corresponding liquid crystal capacitor 170 and storage capacitor 180 of the pixel row for aligning states of the corresponding liquid crystal cells associated with the pixel row to control light transmittance therethrough.

According to the embodiment as shown in FIG. 1, the LCD panel 110 can be considered to be divided into N areas, $\{A_j\}$, along the gate scanning direction 130, where j=1, 2, 3, . . . , N. Each $A_j$ has at least one of the plurality of gate lines 122, 124, . . . and is in communication with the plurality of data lines 152, 154, . . . . In the exemplary example, N=5, and each of the areas $A_1$ through $A_5$ is defined between two corresponding neighboring gate lines. For example, the area $A_1$ is defined between the gate lines 122 and 124, and the area $A_2$ is defined between the gate lines 124 and 126, and so on. Each of the areas $A_1$ through $A_5$ can be characterized with a corresponding gamma curve, indicated by $Gamma_1$, $Gamma_2$, $Gamma_3$, $Gamma_4$, or $Gamma_5$, as shown in FIG. 1B. Ideally, all of $Gamma_1$ through $Gamma_5$ are the same. In practice, however, $Gamma_1$ through $Gamma_5$ are substantially different from each other, due to the above mentioned drawbacks for the color sequential LCD panel.

Additionally, each of the areas $A_1$ through $A_5$ is also characterized with a corresponding voltage-transmittance function, $T_j=F_j(V_j)$, where j=1, 2, 3, 4 or 5, $V_j$ is a voltage applied to the area $A_j$ to drive the liquid crystals associated with the area $A_j$, and $T_j$ is a light transmittance through the area $A_j$, which is a function, $F_j(V_j)$, of the applied voltage $V_j$. Different areas of the LCD panel 110 have different voltage-transmittance functions. The difference between the voltage-transmittance functions of different areas relates to at least one of the difference between the response time of liquid crystals associated with different areas, and the difference between scanning times at different gate lines.

Figure 2:
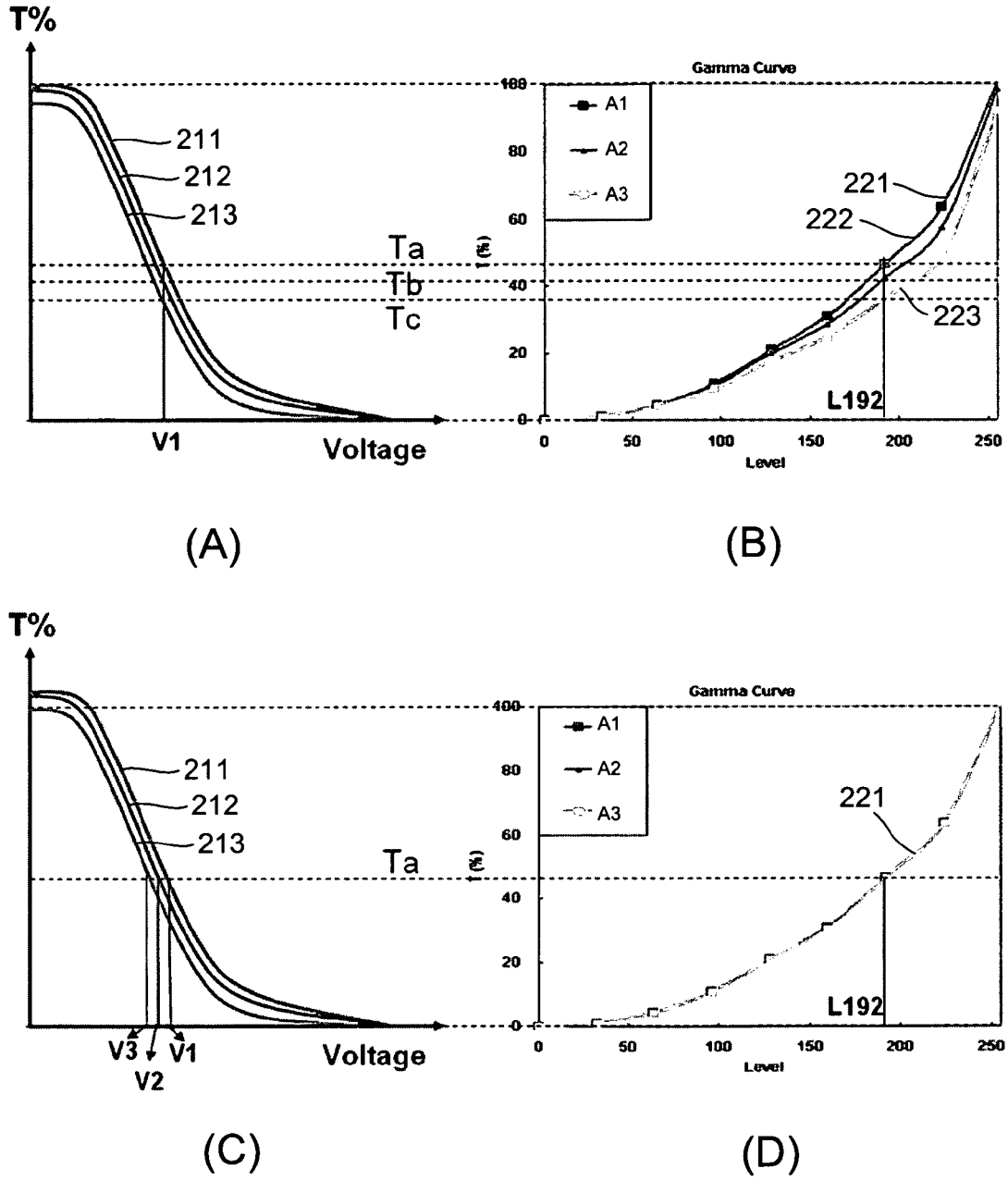
FIG. 2 shows schematically a gamma correction process for an LCD device according to one embodiment of the present invention: (A) the one-to-one correspondence of a voltage-transmittance function and its gamma curve of each area of an LCD panel of the LCD device, and (B) the correspondence of voltage-transmittance functions of different areas and a desired gamma curves of the LCD panel of the LCD device.

The gamma curve of each area is corresponding to the voltage-transmittance function of the area of the LCD panel. The one-to-one correspondence between the voltage-transmittance function and the gamma curve of each area is shown in FIG. 2, for example, for the first three areas, $A_1$, $A_2$ and $A_3$ of the LCD panel. In this exemplary embodiment, each pixel of an image is graded in 8 bits; that is, the image is scaled into 256 grey levels from 0 (black) to 255 (white). Other number of bits can also be utilized to practice the present invention. FIG. 2A shows the voltage-transmittance functions 211, 212 and 213, and FIG. 2B shows the gamma curves 221, 222 and 223 of the areas $A_1$, $A_2$ and $A_3$ of an LCD panel, respectively. It is evident from the graphs of FIG. 2A that the voltage-transmittance functions 211, 212 and 213 are different from each other, and the gamma curves 221, 222 and 223 are different from each other as well. For a given grey level L, for example, L=L192=192, the light transmittances through the areas $A_1$, $A_2$ and $A_3$ of the LCD panel are respectively $T_a$, $T_b$ and $T_c$, according to the gamma curves 221, 222 and 223 of the areas $A_1$, $A_2$ and $A_3$ of the LCD panel, where $T_a>T_b>T_c$. In other words, the given grey level L=L192=192 is corresponding to a grey level voltage, V1, applied to the areas $A_1$, $A_2$ and $A_3$ of the LCD panel, as shown in FIG. 2A. As a result, the brightness through the area $A_1$ is brighter than that through the area $A_2$, which, in turn, is brighter than that through the area $A_3$ of the LCD panel. Therefore, an image displayed has non-uniform brightness over the LCD panel.

To obtain uniform brightness over all areas of the LCD panel, for each area $A_j$, its corresponding grey level voltage needs to be optimized from the corresponding voltage-transmittance function of the area in accordance with a desired gamma curve of the LCD panel so that the light transmittance (brightness) through each area $A_j$ is the same for a given grey level L. The desired gamma curve of the LCD panel can be a theoretically designed gamma curve of the LCD panel, or a selected one from gamma curves of the areas $A_1$, $A_2$, . . . , and $A_N$ of the LCD panel. According to one embodiment of the present invention, for each area $A_j$ and a given grey level L, its optimal grey level voltage $V_{jL}$ is determined from the corresponding voltage-transmittance function $T_j=F_j(V_j)$ of the area $A_j$, in accordance with the desired gamma curve of the LCD panel such that when the optimal grey level voltages $V_{1L}$, $V_{2L}$, . . . , and $V_{NL}$ are respectively applied to the areas $A_1$, $A_2$, . . . , and $A_N$ for the given grey level, L, a light transmittance $T_j$ through each area $A_j$ is substantially uniform, that is $T_1=T_2=\ldots=B_L$, where $B_L$ is the brightness (luminance) at the grey level L according to the desired gamma of the LCD panel. That is, each optimal grey level voltage $V_{jL}$ satisfies the relation of $B_L=F_j(V_{jL})$, j=1, 2, . . . , N. For an 8-bit image to be displayed at the LCD device, L=0, 1, 2, . . . , 255. The gamma correction process for different areas of the LCD panel according to one embodiment of the present invention is shown in principle in FIG. 2B.

As shown in FIG. 2B, the desired gamma curve of the LCD panel is selected to be the gamma curve 221, $Gamma_1$, of the area $A_1$. According to the gamma curve 221, for a given grey level, L=L192=192, the light transmittance (brightness) through the LCD panel is $T_a$. Given the amount of the light transmittance $T_a$, the optimal grey level voltages to be applied to the areas $A_1$, $A_2$ and $A_3$ are respectively V1, V2 and V3, which are determined from the voltage-transmittance functions 211, 212 and 213, respectively. That is, when the areas $A_1$, $A_2$ and $A_3$ of the LCD panel are respectively driven by the optimal grey level voltages V1, V2 and V3, the light transmittance through each area $A_1$, $A_2$ or $A_3$ of the LCD panel is substantially uniform and has a value of $T_a$. Table 1 lists the optimal grey level voltages to be applied to the areas $A_1$, $A_2$ and $A_3$ for the given grey level L=L192=192, which are also shown in FIGS. 2C and 2D.

TABLE 1

Grey level voltages versus grey levels according to the present invention.

| Area | Grey Level Voltages for Grey Levels, L0-L225 | | | | | |
|---|---|---|---|---|---|---|
| | L0 | L2 | . . . | L192 | . . . | L255 |
| $A_1$ | | | | V1 | | |
| $A_2$ | | | | V2 | | |
| $A_3$ | | | | V3 | | |

Figure 3:
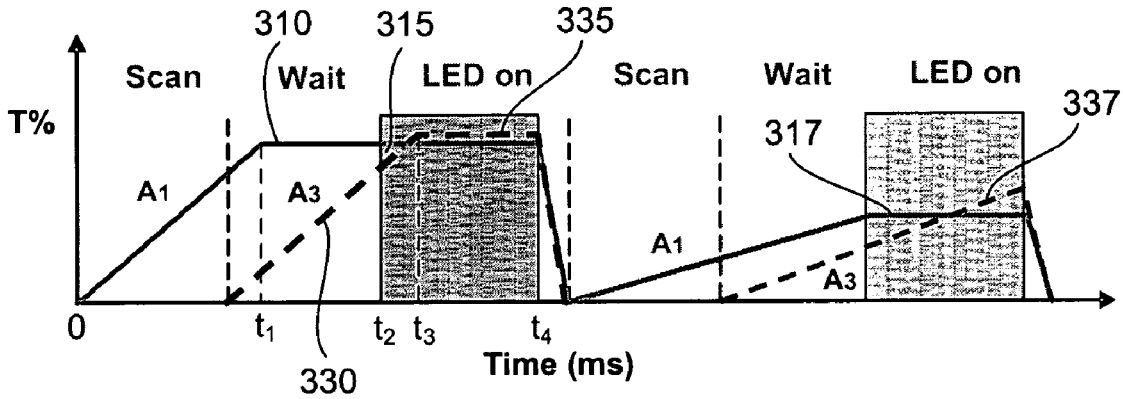
FIG. 3 shows schematically (A) a chart of response times and corresponding luminance of different areas of an LCD panel of an LCD device according to one embodiment of the present invention, and (B) the corresponding luminance of different areas of the LCD panel.
Figure 3:
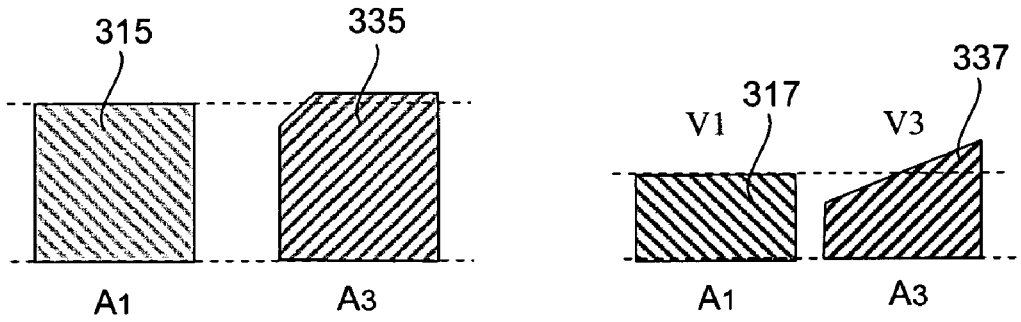

Referring to FIG. 3, the gamma correction process for the LCD panel of FIG. 1 is shown. Curves 310 and 330 are respectively corresponding to the responses of the liquid crystals associated with, for example, the areas $A_1$ and $A_3$ of the LCD panel, or the luminous fluxes of light through the areas $A_1$ and $A_3$ of the LCD panel, respectively. During the first scan period (frame), for the area $A_1$, the response of the liquid crystals completes at time $t_1$, while the liquid crystals of the area $A_3$ fully respond at time $t_3$, to driving signals (not shown). The backlight, such as LEDs, is turned on and off at time $t_2$ and $t_4$, respectively, where $t_1<t_2<t_3<t_4$. According to the present invention, for a given grey level, for example, L=L192=192, the areas $A_1$ and $A_3$ are driven by the optimal grey level voltages V1 and V3, respectively. The luminance through the areas $A_1$ and $A_3$ are respectively corresponding to integrated areas 315 and 335 of the luminous fluxes 310 and 330 of light during the time period ($t_4-t_2$) when the backlight, such as LEDs, is turned on. As shown in FIG. 3B, both integrated areas 315 and 335 are same in size. The luminance through the areas $A_1$ and $A_3$ in the second scan period (frame) is represented by integrated areas 317 and 337, respectively, which are also equal in size.

In one embodiment, a lookup table (LUT) is set from the corresponding voltage-transmittance function $T_j=F_j(V_j)$ of each areas $A_j$ of the LCD panel in accordance with the desired gamma of the LCD panel, j=1, 2, 3, . . . , N. As shown in Table 2, the LUT has a set of grey levels of 8 bits, {L}={L0, L1, . . . , L255}={0, 1, . . . , 255}. Other number of bits can also be utilized to practice the present invention. Each grey level L is associated with N optimal grey level voltages, $V_{1L}$, $V_{2L}$, . . . , and $V_{NL}$, to be applied to the N areas, $A_1$, $A_2$, . . . , and $A_N$, of the LCD panel, respectively. In one embodiment, the N optimal grey level voltages, $V_{1L}$, $V_{2L}$, . . . , and $V_{NL}$, are obtained by (i) characterizing the brightness, $\{B_L\}$, versus a set of grey levels, {L}, from the desired gamma curve of the LCD panel, where each characterized brightness, $B_L$, corresponds to uniquely a grey level L; and (ii) for each characterized brightness $B_L$, finding the N optimal grey level voltages, $V_{1L}$, $V_{2L}$, . . . , and $V_{NL}$, from the voltage-transmittance functions, $T_1=F_1(V_1)$, $T_2=F_2(V_2)$, . . . , and $T_N=F_N(V_N)$, of the N areas, $A_1$, $A_2$, . . . , and $A_N$, of the LCD panel, respectively, where the N optimal grey level voltages, $V_{1L}$, $V_{2L}$, . . . , and $V_{NL}$, satisfy the relation of $F_1(V_{1L})=F_2(V_{2L})=\ldots=F_N(V_{NL})=B_L$.

TABLE 2

Grey level voltages versus grey levels according to the present invention.

| Area | Grey Level Voltages for Grey Levels, L0-L225 | | | | |
|---|---|---|---|---|---|
| | L0 | L1 | . . . | L254 | L255 |
| $A_1$ | $V_{1L0}$ | $V_{1L1}$ | | $V_{1L254}$ | $V_{1L255}$ |
| $A_2$ | $V_{2L0}$ | $V_{2L1}$ | | $V_{2L254}$ | $V_{2L255}$ |
| . . . | | | | | |
| $A_N$ | $V_{NL0}$ | $V_{NL1}$ | | $V_{NL254}$ | $V_{NL255}$ |

In the LUT listed in Table 2, the first row is corresponding to the set of grey levels, L0, L1, . . . , L254, and L255, and the second through the (N+1)th rows represent the grey level voltages corresponding to the set of grey levels for the areas, $A_1$, $A_2$, . . . , and $A_N$, of the LCD panel, respectively. Each area $A_j$ of the LCD panel has its own driving (grey level) voltages in order to make the light transmittance through each area $A_j$ of the LCD panel substantially uniform for a given grey level. The LUT may be arranged in other forms.

For an image to be displayed properly in a display device such as an LCD, it may be decomposed into a number of frames. Each frame is mapped onto the pixel matrix of the LCD panel in terms of grey levels such that a grey level associated with a pixel is corresponding to the shade of grey of the frame to be displayed at the pixel of the LCD panel.

In operation, for each frame of an image to be displayed, the LUT is looked up to determine grey level voltages, each adapted for driving a corresponding pixel of the LCD panel, in accordance with the mapped grey level at each pixel for the frame of the image. When gate signals generated from a gate driver are sequentially applied to each of the plurality of gate lines to activate the area $A_j$ of the LCD panel through its corresponding gate lines associated with the area $A_j$ in a scanning period that is corresponding to a frame of the image, the determined grey level voltages generated from a data driver is simultaneously applied to the activated area $A_j$ through the plurality of data lines. Accordingly, the brightness of each area of the LCD panel is substantially uniform for a given grey level.

Figure 4:
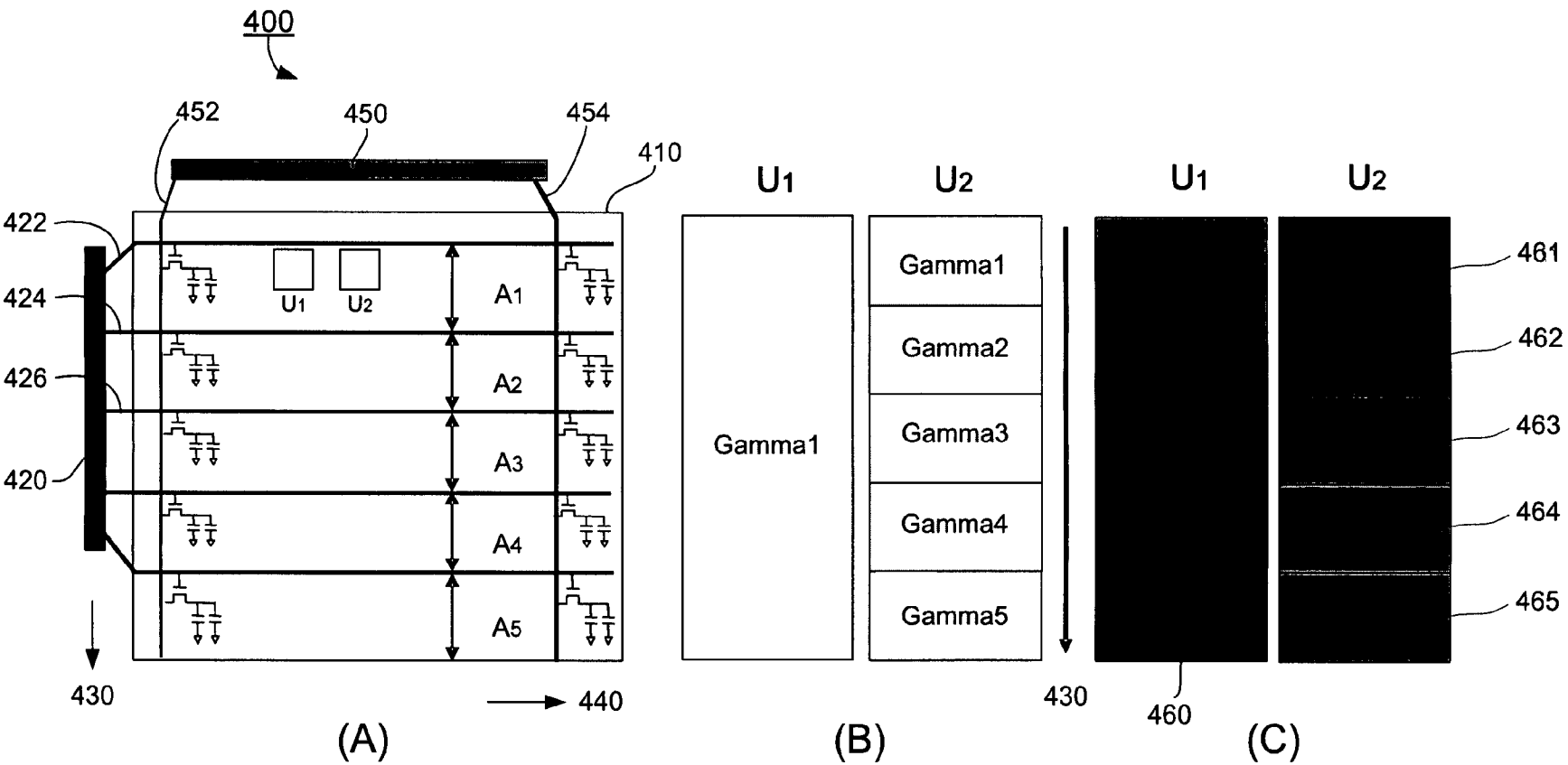
FIG. 4 partially shows schematically an LCD device according to one embodiment of the present invention: (A) a schematic of an LCD panel of the LCD device, having a plurality of areas each having a plurality of area units, (B) a chart of gammas for area units of different areas and of the LCD panel, and (C) luminance of area units of different areas of the LCD panel.

Referring to FIG. 4, a gamma correction process for a color sequential LCD device is schematically shown according to one embodiment of the present invention. The LCD 400 has an LCD panel 410 formed with a plurality of gate lines 422, 424, . . . that are spatially arranged along a gate scanning direction 430, and a plurality of data lines 452, 454, . . . that are spatially arranged along a direction 440 substantially perpendicular to the gate scanning direction 430.

The exemplary process includes the following steps: at first, the LCD panel 410 is divided into five areas, $A_1$ through $A_5$, along the gate scanning direction 430. The LCD panel 410 may be divided into as many areas as desired. Each area $A_j$ includes at least two area units, $U_{j1}$ and $U_{j2}$, j=1, 2, 3, . . . , or 5. Each area $A_j$ is characterized with a corresponding gamma curve, $Gamma_1$, $Gamma_2$, . . . , or $Gamma_5$, as shown in FIG. 4B. Each of the gamma curves, $Gamma_1$ through $Gamma_5$, has a one-to-one correspondence to a voltage-transmittance function, $T_j=F_j(V_j)$, of a corresponding area $A_j$, where $V_j$ is a voltage applied to the area $A_j$, and $T_j$ is a light transmittance through the area $A_j$ which is a function, $F_j(V_j)$, of the applied voltage V.

Each area $A_j$ may include at least one of the plurality of gate lines 422, 424, . . . and is in communication with the plurality of data lines 452, 454, . . . . Alternatively, each area $A_j$ of the LCD panel may be an area of the LCD panel defined between two corresponding neighboring gate lines of the plurality of gate lines 422, 424, . . . . Each of the at least two area units, $U_{j1}$ and $U_{j2}$ of an area $A_j$ of the LCD panel may be substantially coincident with a pixel of the area $A_j$, where the pixel is defined between two neighboring gate lines of the plurality of gate lines 422, 424, . . . and two neighboring data lines of the plurality of data lines 452, 454, . . . crossing the two neighboring gate lines of the plurality of gate lines 422, 424, . . . .

From the voltage-transmittance function $T_1=F_1(V_1)$ of the area $A_1$ and the gamma curve, $Gamma_1$, of the area $A_1$, a first set of grey level voltages, $\{V_L\}$, corresponding to a set of grey levels, $\{L\}$, is determined. Each grey level L is associated with one of shades of grey of a frame of an image to be displayed at a pixel of the LCD panel, where L=0, 1, 2, . . . , $(2^n-1)$, n being an integer greater than zero and a number of bits of the image.

From the voltage-transmittance function $T_j=F_j(V)$ of each area $A_j$ and a desired gamma curve of the LCD panel, a second set of grey level voltages, $\{V_{jL}\}$, corresponding to the set of grey levels $\{L\}$ is determined such that when the grey level voltages $V_{1L}, V_{2L}, \ldots$, and $V_{NL}$ are respectively applied to the N areas $\{A_j\}$ for a grey level L, a light transmittance through each area $A_j$ is substantially uniform and equals to a brightness, $B_L$, determined by the desired gamma curve of the LCD panel at the grey level L. The desired gamma curve of the LCD panel can be one of the gamma curves, $Gamma_1$ through $Gamma_5$.

To compensate for the brightness through each area of the LCD panel 410, during each frame of an image, which is corresponding to each scanning period of the plurality of gate lines 422, 424, . . . , the area unit $U_{j1}$ of each area $A_j$ is driven with grey level voltages selected from the first set of grey level voltages $\{V_L\}$ corresponding to grey levels of the frame of the image to be displayed at the area unit $U_{j1}$ of each area $A_j$, through data lines associated with the area unit $U_{j1}$ of each area $A_j$. And the area unit $U_{j2}$ of each area $A_j$ is driven with grey level voltages selected from the second set of grey level voltages $\{V_{jL}\}$ corresponding to grey levels of the frame of the image to be displayed at the area unit $U_{j2}$ of each area $A_j$, through data lines associated with the area unit $U_{j2}$ of each area $A_j$. As shown in FIG. 4C, chart 460 is corresponding to luminance passing through the entire LCD panel 410 according to the gamma curve, $Gamma_1$, of the area $A_1$, where the grey level voltages (driving voltages) are identical over all of the areas, $A_1$ through $A_5$, of the LCD panel 410 for a given grey level. Charts 461-465 are corresponding to luminance passing through the areas, $A_1$ through $A_5$, respectively, where the grey level voltages (driving voltages) are different for different areas of the LCD panel 410 for a given grey level.

Figure 5:
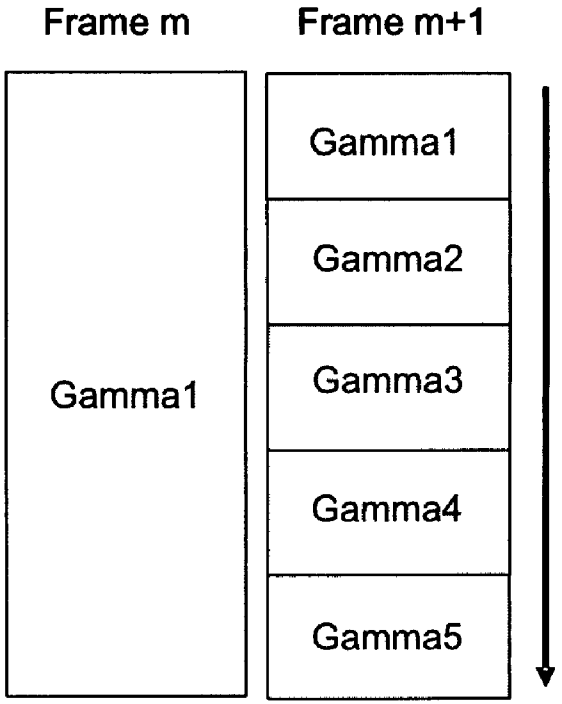
FIG. 5 partially shows schematically a gamma correction process for an LCD device according to one embodiment of the present invention: (A) two consecutive image frames, and (B) a chart of gammas for different image frames.
Figure 5:
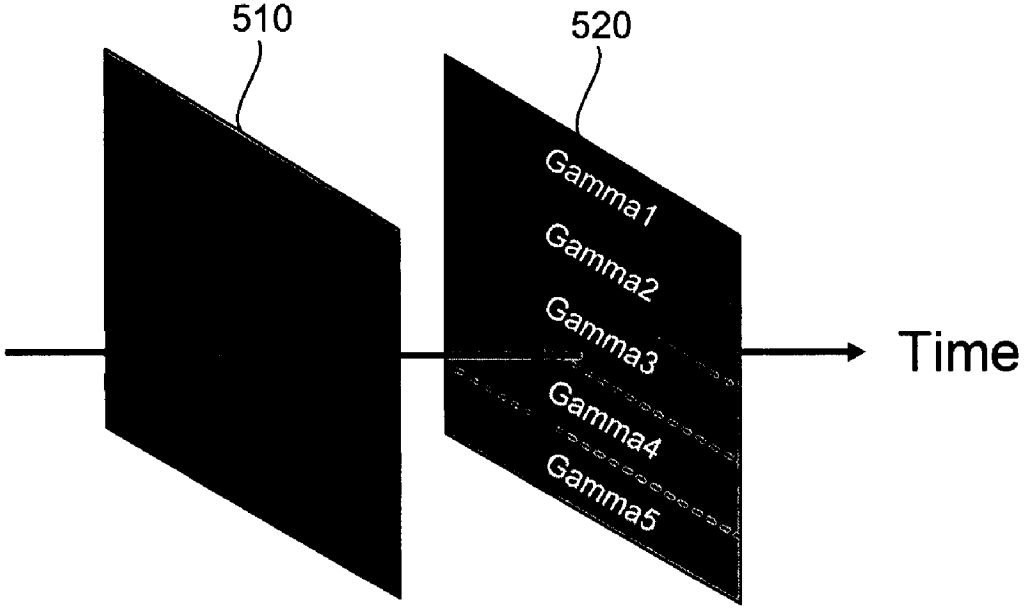

Referring to FIG. 5, a gamma correction process for a color sequential LCD device is schematically shown according to another embodiment of the present invention. To illustrate the process, the LCD panel (not shown) is divided into five areas, $A_1$ through A5, along a gate scanning direction, each area $A_j$ having M area units $\{U_{jk}\}$, j=1, 2, 3, . . . , 5, and k=1, 2, 3, . . . , M, M being an integer greater than one.

The gamma correction can be utilized by temporal compensations for different frames of an image to be displayed. In the exemplary embodiment, the image is decomposed into a number of frames (or sub-frame). An m-th frame and an (m+1) frame are two consecutive frames of the image, where m=1, 2, . . . , P, P being an integer greater than one and a number of frame of the image. As shown in FIG. 5, for the m-th frame 510 of the image, the driving voltages (grey level voltages) are determined from the voltage-transmittance function $T_1=F_1(V_1)$ of the area $A_1$ and the gamma curve, $Gamma_1$, of the area $A_1$, while, for the (m+1)-th frame 520 of the image, the driving voltages are determined from the voltage-transmittance function $T_j=F_j(V_j)$ of each area $A_j$ and a desired gamma curve of the LCD panel. Specifically, during the m-th frame 510 of the image (the m-th scanning period of gate lines), each one of the area units $\{U_{jk}\}$ is driven with the grey level voltages selected from the first set of grey level voltages $\{V_L\}$ corresponding to grey levels of the m-th frame 510 of the image to be displayed at the one of the area units $\{U_{jk}\}$ through data lines associated with the one of the area units $\{U_{jk}\}$. During the (m+1)-th frame 520 of the image (the (m+1)-th scanning period of gate lines), each one of the area units $\{U_{jk}\}$ is driven with the grey level voltages selected from the second set of grey level voltages $\{V_{jL}\}$ corresponding to grey levels of the (m+1)-th frame 520 of the image to be displayed at the one of the area units $\{U_{jk}\}$ through data lines associated with the one of the area units $\{U_{jk}\}$. Additionally, the grey level voltages driving each one of the area units $\{U_{jk}\}$ for the (m+1)-th frame 520 of the image may have an opposite bias to these driving the one of the area units $\{U_{jk}\}$ for the m-th frame 510 of the image.

Figure 6:
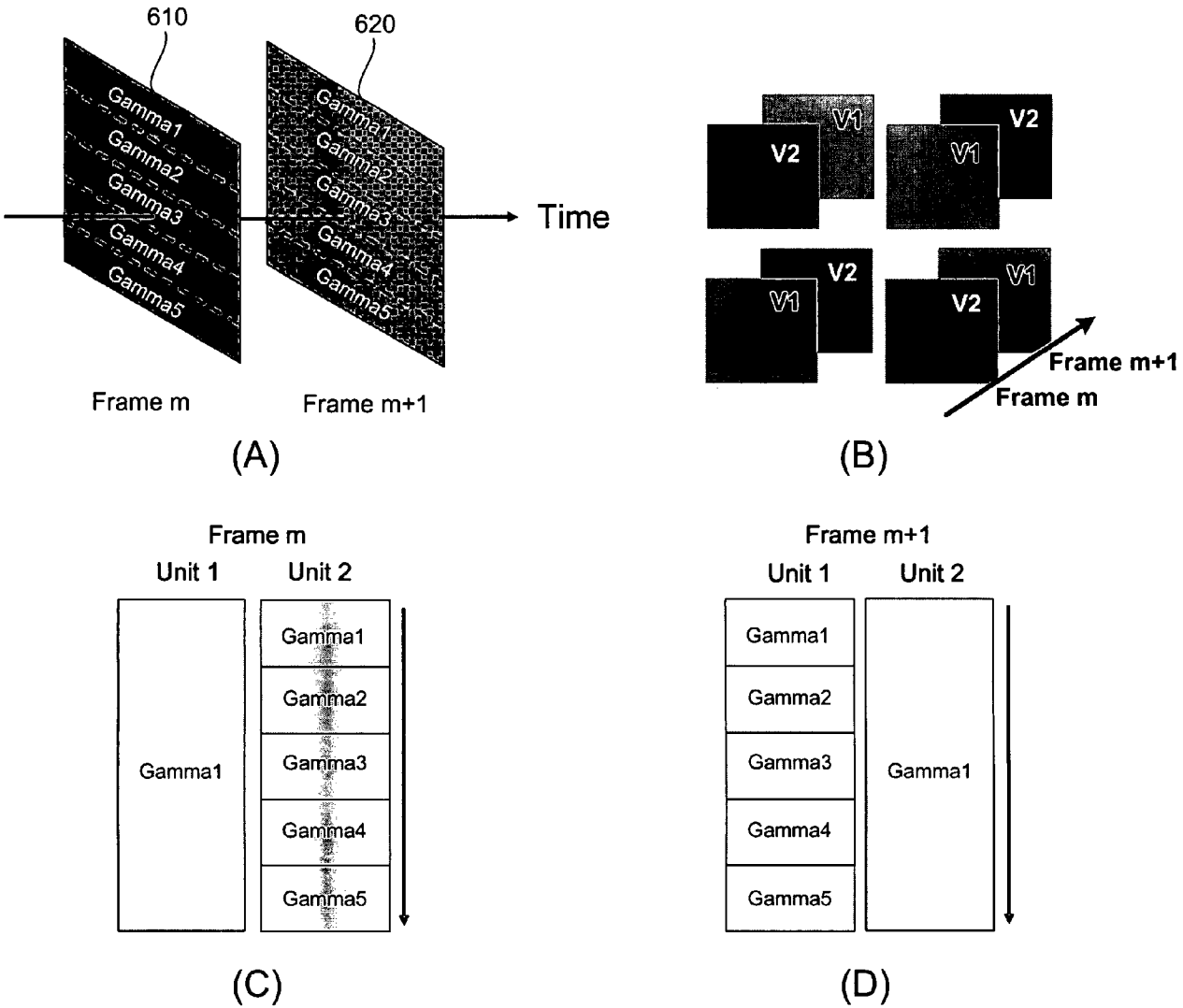
FIG. 6 partially shows schematically a gamma correction process for an LCD device according to another embodiment of the present invention: (A) two consecutive image frames, (B) a schematic of the process, and (C) and (D) a chart of gammas for different image frames.
Figure 8:
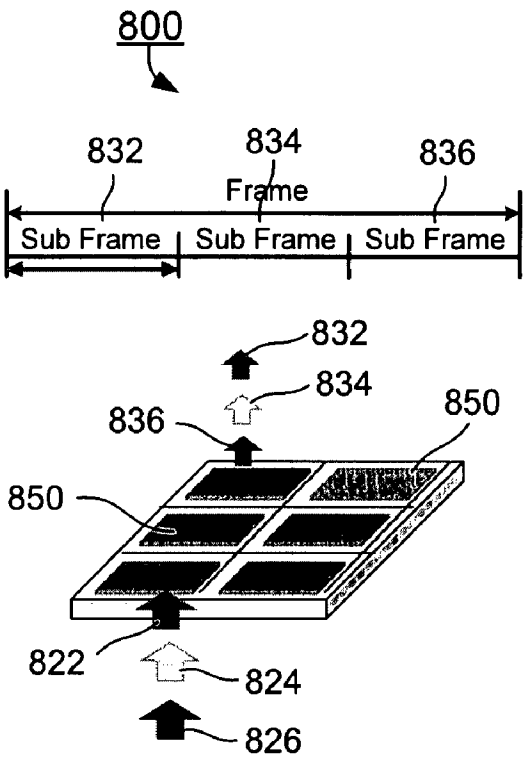
Fig. 8 (Related Art)
FIG. 8 partially shows schematically a color displaying process for a conventional color sequential LCD.
Figure 7:
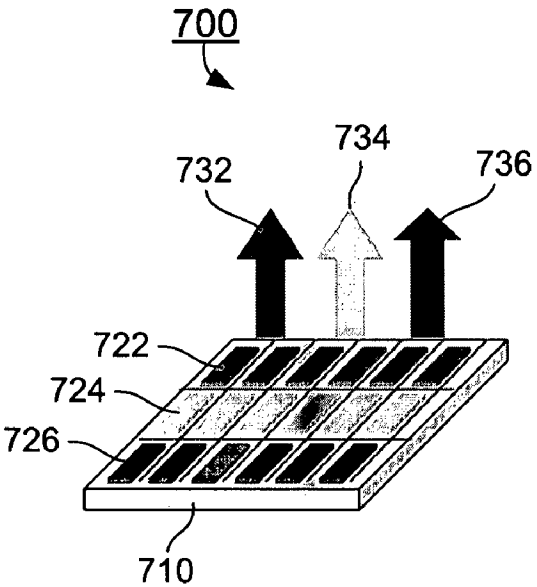
Fig. 7 (Related Art)
FIG. 7 partially shows schematically a color displaying process for a conventional color filter LCD.
Figure 9:
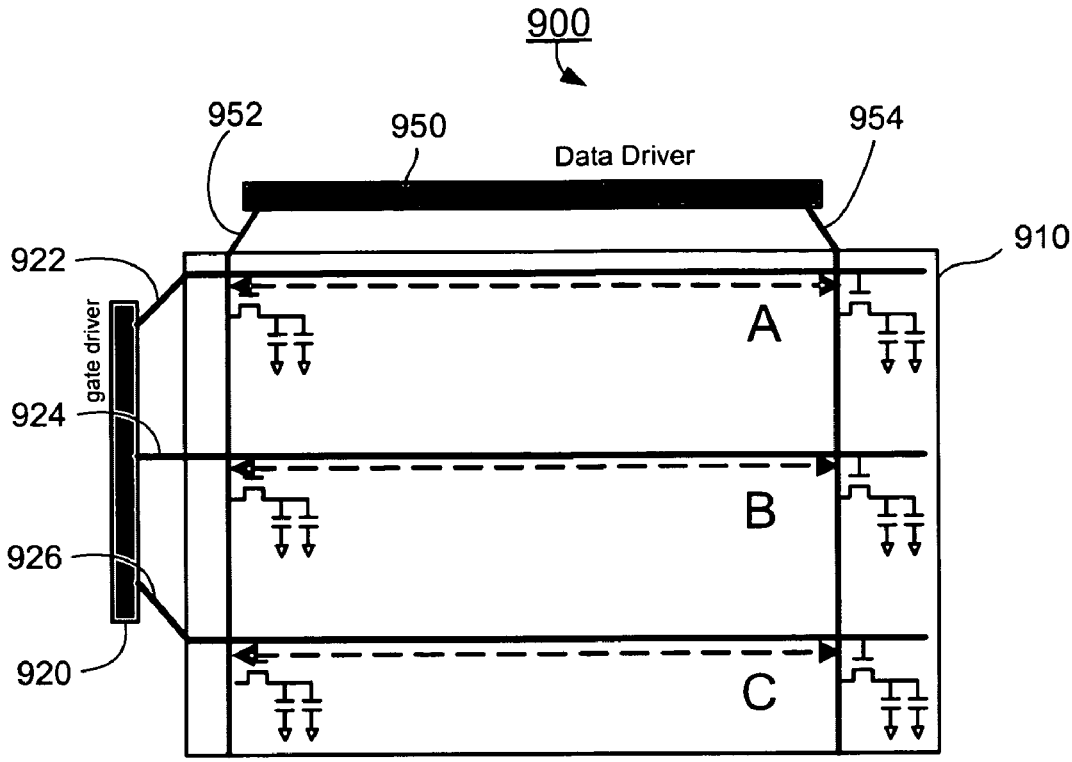
FIG. 9 shows schematically (A) a schematic of a conventional LCD device, and (B) a chart of response times and corresponding luminance of different areas of an LCD panel of the conventional LCD device.
Figure 9:
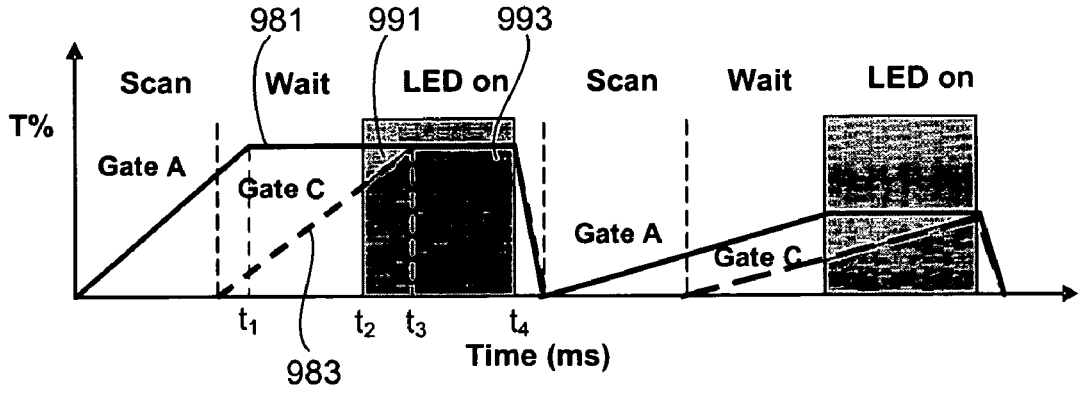
Figure 10:
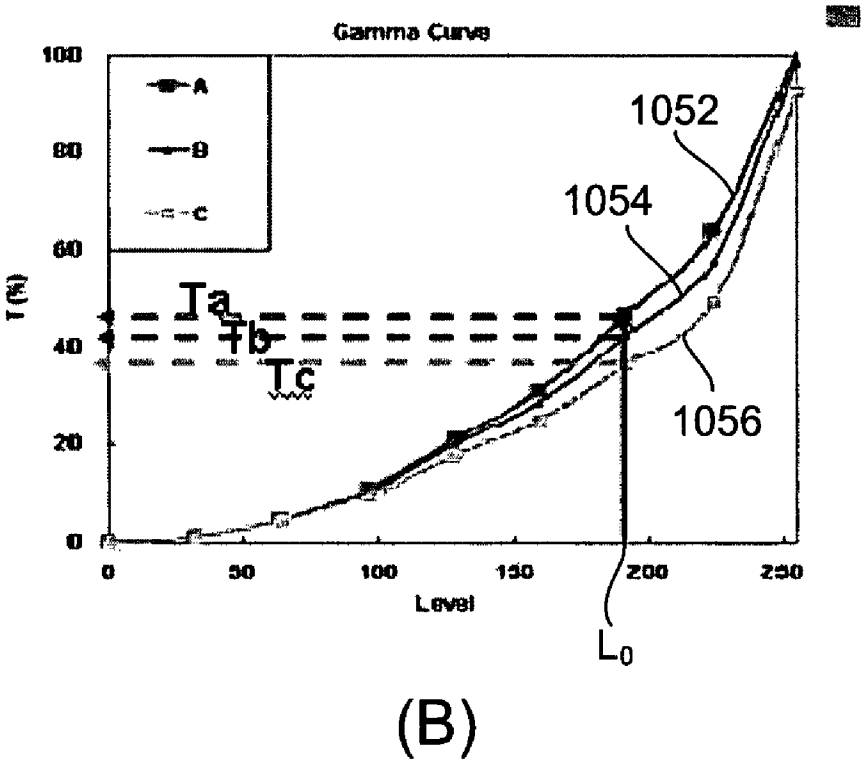
FIGS. 10A and 10B show the gamma curves for a conventional color filter LCD and a conventional color sequential LCD, respectively.
Figure 10:
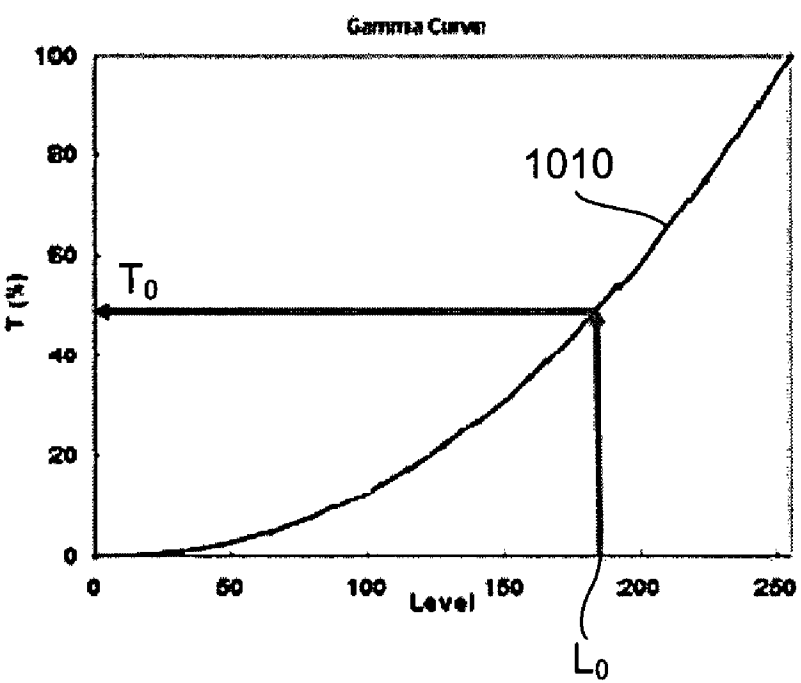

Referring to FIG. 6, a gamma correction process for a color sequential LCD device is schematically shown according to an alternative embodiment of the present invention. The LCD panel (not shown) is still divided into five areas, $A_1$ through $A_5$, along a gate scanning direction, where each area $A_j$ has at least area units $U_{j1}$ and $U_{j2}$, j=1, 2, 3, . . . , and 5.

The gamma correction process is performed with both spatial compensations for the at least area units $U_{j1}$ and $U_{j2}$ of each area $A_j$, and temporal compensations for different frames of an image in each of the at least area units $U_{j1}$ and $U_{j2}$ of each area $A_j$. For example, during an m-th frame 610 of the image (the m-th scanning period of gate lines), where m=1, 2, . . . , P, P being an integer greater than one and a number of frame of the image, the driving voltages for the area unit $U_{j1}$ of each area $A_j$ are determined from the voltage-transmittance function $T_1=F_1(V_1)$ of the area $A_1$ and the gamma curve, $Gamma_1$, of the area $A_1$, while the driving voltages for the area unit $U_{j2}$ of each area $A_j$ are determined from the corresponding voltage-transmittance function $T_j=F_j(V_j)$ of each area $A_j$ and a desired gamma curve of the LCD panel, as shown in FIG. 6C. However, during an (m+1)-th frame 620 of the image, the driving voltages for the area unit $U_{j1}$ of each area $A_j$ are determined from the voltage-transmittance function $T_j=F_j(V_j)$ of each area $A_j$ and the desired gamma curve of the LCD panel, and the driving voltages for the area unit $U_{j2}$ of each area $A_j$ are determined from the voltage-transmittance function $T_1=F_1(V_1)$ of the area $A_1$ and the gamma curve, $Gamma_1$, of the area $A_1$, as shown in FIG. 6D.

More specifically, during the m-th frame 610 of the image, the area unit $U_{j1}$ of each area $A_j$ is driven with the grey level voltages selected from the first set of grey level voltages $\{V_L\}$ corresponding to grey levels of the m-th frame 610 of the image to be displayed at the area unit $U_{j1}$ of each area $A_j$, through data lines associated with the area unit $U_{j1}$ of each area $A_j$. Meanwhile, the area unit $U_{j2}$ of each area $A_j$ is driven with the grey level voltages selected from the second set of grey level voltages $\{V_{jL}\}$ corresponding to grey levels of the m-th frame 610 of the image to be displayed at the area unit $U_{j2}$ of each area $A_j$, through data lines associated with the area unit $U_{j2}$ of each area $A_j$.

During the (m+1)-th frame 620 of the image, the area unit $U_{j1}$ of each area $A_j$ is driven with the grey level voltages selected from the second set of grey level voltages $\{V_{jL}\}$ corresponding to grey levels of the (m+1)-th frame 620 of the image to be displayed at the area unit $U_{j1}$ of each area $A_j$, through data lines associated with the area unit $U_{j1}$ of each area $A_j$. Meanwhile, the area unit $U_{j2}$ of each area $A_j$ is driven with the grey level voltages selected from the first set of grey level voltages $\{V_L\}$ corresponding to grey levels of the (n+)-th frame 620 of the image to be displayed at the area unit $U_{j2}$ of each area $A_j$, through data lines associated with the area unit $U_{j2}$ of each area $A_j$.

The uniformity of the brightness over the LCD panel is realized accordingly through such gamma corrections.

Thus, one aspect of the present invention provides an LCD device that utilities the above disclosed methods for gamma corrections.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as being suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A method of gamma correction for a liquid crystal display (LCD) with color-sequential display, wherein the LCD comprises an LCD panel having a plurality of gate lines, a plurality of data lines, and a plurality of pixels spatially arranged in a matrix, each pixel being defined between two neighboring gate lines and two neighboring data lines crossing the two neighboring gate lines, and being capable of displaying n bits of image data, comprising the steps of:

a. dividing the LCD panel along a gate scanning direction into N areas, $\{A_j\}$, j=1, 2, 3, . . . , N, N being an integer greater than one, wherein each area $A_j$ is characterized with a corresponding light transmittance, $T_j$, which is a function of a voltage $V_j$ applied to the area $A_j$, $T_j=F_j(V_j)$;

b. selecting a desired gamma curve; and c. determining grey level voltages, $V_{j0}, V_{j1}, \ldots, V_{jL}, \ldots$ of each area $A_j$ for each of a set of grey levels, $\{L\}$, L=0, 1, 2, . . . , $(2^n-1)$, from the corresponding function $T_j=F_j(V_j)$ and the desired gamma curve such that when the grey level voltages $V_{1L}, V_{2L}, \ldots$, and $V_{NL}$ are respectively applied to the N areas $\{A_j\}$ for a grey level, L, a light transmittance through each area $A_j$ is substantially uniform and equal to a corresponding brightness, $B_L$.

2. The method of claim 1, further comprising the step of setting up a lookup table (LUT) from the voltage-transmittance function $T_j=F_j(V_j)$ of each areas $A_j$ and the desired gamma curve.

3. The method of claim 2, wherein the LUT comprises the set of grey levels, $\{L\}$, each grey level L being associated with a brightness, $B_L$, determined by the desired gamma curve at the grey level L, and N grey level voltages $V_{1L}, V_{2L}, \ldots$, and $V_{NL}$ to be applied to the N areas $A_1, A_2, \ldots$, and $A_N$, respectively, and wherein each grey level voltage $V_{jL}$ satisfies the relation of $B_L=F_j(V_{jL})$, j=1, 2, . . . , N, and L=0, 1, . . . , $(2^n-1)$.

4. The method of claim 3, further comprising the step of mapping grey levels of each frame of an image onto the pixel matrix of the LCD panel such that a grey level associated with a pixel is corresponding to the shade of grey of the frame to be displayed at the pixel.

5. The method of claim 4, wherein the step of determining grey level voltages comprises the step of looking up the LUT to determine grey level voltages, in accordance with the mapped grey level at each pixel for a frame of the image.

6. The method of claim 5, further comprising the steps of:

a. sequentially scanning each of the plurality of gate lines to activate pixels associated with the scanned gate line for each frame of the image; and b. driving the activated pixels with grey level voltages corresponding to grey levels of the frame of the image to be displayed at the activated pixels through the plurality of data lines.

7. The method of claim 1, wherein the voltage-transmittance functions, $\{T_j=F_j(V_j)\}$, j=1, 2, . . . , N, are identical or different from each other.

8. The method of claim 7, wherein each area $A_j$ of the LCD panel is characterized with a gamma curve, $Gamma_j$, which is corresponding to the voltage-transmittance function $T_j=F_j(V_j)$ of the area $A_j$.

9. The method of claim 8, wherein the desired gamma curve is selected as one of $Gamma_1$, $Gamma_2$, . . . , and $Gamma_N$.

10. The method of claim 8, wherein the difference between the voltage-transmittance functions of different areas relates to at least one of the difference between the response times of liquid crystals associated with different areas, and the difference between scanning times at different gate lines.

11. A liquid crystal display (LCD) with color-sequential display, comprising:

a. an LCD panel having a plurality of gate lines, a plurality of data lines, and a plurality of pixels spatially arranged in a matrix, each pixel being defined between two neighboring gate lines and two neighboring data lines crossing the two neighboring gate lines, and being capable of displaying n bits of image data, wherein the LCD panel is divided along a gate scanning direction 130 into N areas, $\{A_j\}$, j=1, 2, . . . , N, N being an integer greater than one, and wherein each area $A_j$ is characterized with a corresponding light transmittance, $T_j$, which is a function of a voltage $V_j$ applied to the area $A_j$, $T_j=F_j(V_j)$; and b. a controller programmed to determine grey level voltages, $V_{j0}, V_{j1}, \ldots, V_{jL}, \ldots$ of each area $A_j$ for each of a set of grey levels, $\{L\}$, L=0, 1, 2, . . . , $(2^n-1)$, from the corresponding function $T_j=F_j(V_j)$ and a desired gamma curve such that when the grey level voltages $V_{1L}$, $V_{2L}, \ldots$, and $V_{NL}$ are respectively applied to the N areas $\{A_j\}$ for a grey level, L, a light transmittance through each area $A_j$ is substantially uniform and equal to a corresponding brightness, $B_L$.

12. The LCD of claim 11, further comprising means for setting up a lookup table (LUT) from the voltage-transmittance function $T_j=F_j(V_j)$ of each areas $A_j$ and the desired gamma of the LCD panel.

13. The LCD of claim 12, wherein the LUT comprises the set of grey levels $\{L\}$, each grey level L being associated with a brightness, $B_L$, determined by the desired gamma of the LCD panel at the grey level L, and N grey level voltages $V_{1L}$, $V_{2L}, \ldots$, and $V_{NL}$ to be applied to the N areas $A_1, A_2, \ldots$, and $A_N$, respectively, wherein each grey level voltage $V_{jL}$ satisfies the relation of $B_L=F_j(V_{jL})$, j=1, 2, 3, . . . , N, and L=0, 1, 2, . . . , $(2^n-1)$.

14. The LCD of claim 13, further comprising means for mapping grey levels of each frame of an image onto the pixel matrix of the LCD panel such that a grey level associated with a pixel is corresponding to the shade of grey of the frame of an image to be displayed at the pixel.

15. The LCD of claim 14, further comprising means for looking up the LUT to determine grey level voltages, each driving a corresponding pixel of the LCD panel, in accordance with the mapped grey level at each pixel for a frame of the image.

16. The LCD of claim 15, further comprising a. a gate driver for generating scanning signals sequentially applied to each of the plurality of gate lines to activate pixels associated with the scanned gate line for each frame of the image; and b. a data driver coupling to the looking up means for grey level voltages corresponding to grey levels of the frame of the image to be displayed at the activated pixels to drive the activated pixels through the plurality of data lines.

17. The LCD of claim 11, wherein the voltage-transmittance functions, $\{T_j=F_j(V_j)\}$, j=1, 2, . . . , N, are identical or different from each other.

18. The LCD of claim 17, wherein each area $A_j$ of the LCD panel is characterized with a gamma curve, $Gamma_j$, which is corresponding to the voltage-transmittance function $T_j=F_j(V_j)$ of the area $A_j$.

19. The LCD of claim 18, wherein the desired gamma curve of the LCD panel is one of $Gamma_1$, $Gamma_2$, . . . , and $Gamma_N$.

20. The LCD of claim 18, wherein the difference between the voltage-transmittance functions of different areas relates to at least one of the difference between the response times of liquid crystals associated with different areas, and the difference between scanning times at different gate lines.

21. The LCD of claim 11, wherein each area $A_j$ includes at least one of the plurality of gate lines and is in communication with the plurality of data lines.

22. The LCD of claim 21, wherein each area $A_j$ of the LCD panel is substantially an area defined between two neighboring gate lines.

23. A method of gamma correction for a liquid crystal display (LCD) with color-sequential display, wherein the LCD comprises an LCD panel having a plurality of gate lines, a plurality of data lines, and a plurality of pixels arranged in a matrix, each pixel being capable of displaying n bits of image data, comprising the steps of:

a. dividing the LCD panel along a gate scanning direction into N areas, $\{A_j\}$, j=1, 2, . . . , N, N being an integer greater than one, wherein each area $A_j$ has at least two area units, $U_{j1}$ and $U_{j2}$, and is characterized with a gamma curve, $Gamma_j$, which is corresponding to a voltage-transmittance function, $T_j=F_j(V_j)$, and wherein $V_j$ is a voltage applied to the area $A_j$, $T_j$ is a light transmittance through the area $A_j$, and $F_j(V_j)$ is a function of the applied voltage $V_j$;

b. determining a first set of grey level voltages, $\{V_L\}$, for area $A_1$, corresponding to a set of grey levels, $\{L\}$, L=0, 1, . . . , $(2^n-1)$, from the voltage-transmittance function $T_1=F_1(V_1)$ of the area $A_1$ and a gamma curve, $Gamma_1$, of the area $A_1$, wherein each grey level L is associated with one of shades of grey of a frame of an image to be displayed at a pixel of the LCD panel;

c. determining a second set of grey level voltages, $\{V_{jL}\}$, for each area $A_j$, corresponding to the set of grey levels $\{L\}$ from the corresponding voltage-transmittance function $T_j=F_j(V_j)$ and a desired gamma curve such that when the second set of grey level voltages $V_{1L}$, $V_{2L}$, . . . , and $V_{NL}$ are respectively applied to the N areas $\{A_j\}$ for a grey level, L, a light transmittance through each area $A_j$ is substantially uniform and equal to a corresponding brightness, $B_L$; and d. driving the area unit $U_{j1}$ of each area $A_j$ with grey level voltages selected from the first set of grey level voltages $\{V_L\}$ corresponding to grey levels of a frame of an image to be displayed at the area unit $U_{j1}$ of each area $A_j$ through data lines associated with the area unit $U_{j1}$ of each area $A_j$, and the area unit $U_{j2}$ of each area $A_j$ with grey level voltages selected from the second set of grey level voltages $\{V_{jL}\}$ corresponding to grey levels of the frame of the image to be displayed at the area unit $U_{j2}$ of each area $A_j$ through data lines associated with the area unit $U_{j2}$ of each area $A_j$, respectively.

24. The method of claim 23, wherein each area $A_j$ includes at least one of the plurality of gate lines and is in communication with the plurality of data lines.

25. The method of claim 24, wherein each area $A_j$ is substantially an area defined between two neighboring gate lines.

26. The method of claim 25, wherein each area unit of an area $A_j$ is substantially coincident with a pixel of the area $A_j$.

27. The method of claim 26, wherein the pixel is defined between two neighboring gate lines and two neighboring data lines crossing the two neighboring gate lines.

28. The method of claim 27, further comprising the step of mapping grey levels of each frame of an image onto the pixel matrix of the LCD panel such that a grey level associated with a pixel is corresponding to the shade of grey of the frame to be displayed at the pixel.

29. The method of claim 23, wherein the voltage-transmittance functions, $\{T_j=F_j(V_j)\}$, j=1, 2, . . . , N, are identical or different from each other.

30. A method of gamma correction for a liquid crystal display (LCD) with color-sequential display, wherein the LCD comprises an LCD panel formed with a plurality of gate lines spatially arranged along a gate scanning direction, a plurality of data lines spatially arranged along a direction substantially perpendicular to the gate scanning direction, and a plurality of pixels arranged in a matrix, each pixel being capable of displaying n bits of image data, comprising the steps of:

a. dividing the LCD panel along the gate scanning direction into N areas, $\{A_j\}$, j=1, 2, . . . , N, each area $A_j$ having M area units $\{U_{jk}\}$, k=1, 2, . . . , M, wherein each area, $A_j$, is characterized with a gamma curve, $Gamma_j$, which is corresponding to a voltage-transmittance function, $T_j=F_j(V_j)$, and wherein $V_j$ is a voltage applied to the area $A_j$, $T_j$ is a light transmittance through the area $A_j$, and $F_j(V_j)$ is a function of the applied voltage $V_j$;

b. determining a first set of grey level voltages, $\{V_L\}$, for area $A_1$, corresponding to a set of grey levels, $\{L\}$, L=0, 1, . . . , $(2^n-1)$, from the voltage-transmittance function $T_1=F_1(V_1)$ of the area $A_1$ and a gamma curve, $Gamma_1$, of the area $A_1$, wherein each grey level L is associated with one of shades of grey of a frame of an image to be displayed at a pixel of the LCD panel;

c. determining a second set of grey level voltages $\{V_{jL}\}$, for each area $A_j$, corresponding to the set of grey levels $\{L\}$ from the corresponding voltage-transmittance function $T_j=F_j(V)$ of each area $A_j$ and a desired gamma curve such that when the grey level voltages $V_{1L}$, $V_{2L}$, . . . , and $V_{NL}$ are respectively applied to the N areas $\{A_j\}$ for a grey level L, a light transmittance through each area $A_j$ is substantially uniform and equal to a corresponding brightness, $B_L$;

d. driving each one of the area units $\{U_{jk}\}$ with grey level voltages selected from the first set of grey level voltages $\{V_L\}$ corresponding to grey levels of an m-th frame of an image to be displayed at the one of the area units $\{U_{jk}\}$ through data lines associated with the one of the area units $\{U_{jk}\}$, wherein m=1, 2, . . . , P, P being an integer greater than one and a number of frame of the image; and e. driving each one of the area units $\{U_{jk}\}$ with grey level voltages selected from the second set of grey level voltages $\{V_{jL}\}$ corresponding to grey levels of an (m+1)-th frame of the image to be displayed at the one of the area units $\{U_{jk}\}$ through data lines associated with the one of the area units $\{U_{jk}\}$.

31. The method of claim 30, wherein each area $A_j$ includes at least one of the plurality of gate lines and is in communication with the plurality of data lines.

32. The method of claim 31, wherein each area $A_j$ of the LCD panel is substantially an area defined between two neighboring gate lines.

33. The method of claim 32, wherein each area unit $U_{jk}$ of an area $A_j$ of the LCD panel is substantially coincident with a pixel of the area $A_j$.

34. The method of claim 33, wherein the pixel is defined between two neighboring gate lines and two neighboring data lines crossing the two neighboring gate lines.

35. The method of claim 34, further comprising the step of mapping grey levels of each frame of the image onto the pixel matrix of the LCD panel such that a grey level associated with a pixel is corresponding to the shade of grey of the frame to be displayed at the pixel.

36. The method of claim 35, wherein the grey level voltages driving each one of the area units $\{U_{jk}\}$ for the m-th frame of the image have an opposite bias to the grey level voltages driving the one of the area units $\{U_{jk}\}$ for the (m+1)-th frame of the image.

37. The method of claim 30, wherein the voltage-transmittance functions, $\{T_j=F_j(V_j)\}$, j=1, 2, . . . , N, are identical or different from each other.

38. A method of gamma correction for a liquid crystal display (LCD) with color-sequential display, wherein the LCD comprises an LCD panel formed with a plurality of gate lines spatially arranged along a gate scanning direction, a plurality of data lines spatially arranged along a direction substantially perpendicular to the gate scanning direction, and a plurality of pixels arranged in a matrix, each pixel being capable of displaying n bits of image data, comprising the steps of:

a. dividing the LCD panel along the gate scanning direction into N areas, $\{A_j\}$, j=1, 2, . . . , N, each area $A_j$ having M area units $\{U_{jk}\}$, k=1, 2, . . . , M, wherein each area, $A_j$, is characterized with a gamma curve, $Gamma_j$, which is corresponding to a voltage-transmittance function, $T_j=F_j(V_j)$, and wherein $V_j$ is a voltage applied to the area $A_j$, $T_j$ is a light transmittance through the area $A_j$, and $F_j(V_j)$ is a function of the applied voltage $V_j$;

b. determining a first set of grey level voltages, $\{V_L\}$, for area $A_1$, corresponding to a set of grey levels, $\{L\}$, L=0, 1, . . . , $(2^n-1)$, from the voltage-transmittance function $T_1=F_1(V_L)$ of the area $A_1$ and a gamma curve, $Gamma_1$, of the area $A_1$, wherein each grey level L is associated with one of shades of grey of a frame of an image to be displayed at a pixel of the LCD panel;

c. determining a second set of grey level voltages $\{V_{jL}\}$, for each area $A_j$, corresponding to the set of grey levels $\{L\}$ from the corresponding voltage-transmittance function $T_j=F_j(V_j)$ of each area $A_j$ and a desired gamma curve such that when the grey level voltages $V_{1L}$, $V_{2L}$, . . . , and $V_{NL}$ are respectively applied to the N areas $\{A_j\}$ for a grey level, L, a light transmittance through each area $A_j$ is substantially uniform and equal to a corresponding brightness, $B_L$;

d. driving the area unit $U_{j1}$ of each area $A_j$ with grey level voltages selected from the first set of grey level voltages $\{V_L\}$ corresponding to grey levels of an m-th frame of an image to be displayed at the area unit $U_{j1}$ of each area $A_j$ through data lines associated with the area unit $U_{j1}$ of each area $A_j$, and the area units $U_{j2}$, $U_{j3}$, . . . , and $U_{jM}$ of each area $A_j$ with grey level voltages selected from the second set of grey level voltages $\{V_{jL}\}$ corresponding to grey levels of the m-th frame of the image to be displayed at the area units $U_{j2}$, $U_{j3}$, . . . , and $U_{jM}$ of each area $A_j$ through data lines associated with the area units $U_{j2}$, $U_{j3}$, . . . , and $U_{jM}$ of each area $A_j$, respectively, wherein m=1, 2, . . . , P, P being an integer greater than one and a number of frame of the image; and e. driving the area unit $U_{j1}$ of each area $A_j$ with grey level voltages selected from the second set of grey level voltages $\{V_{jL}\}$ corresponding to grey levels of an (m+1)-th frame of the image to be displayed at the area unit $U_{j1}$ of each area $A_j$ through data lines associated with the area unit $U_{j1}$ of each area $A_j$, and the area units $U_{j2}$, $U_{j3}$, . . . , and $U_{jM}$ of each area $A_j$ with grey level voltages selected from the first set of grey level voltages $\{V_L\}$ corresponding to grey levels of the (m+1)-th frame of the image to be displayed at the area units $U_{j2}$, $U_{j3}$, . . . , and $U_{jM}$ of each area $A_j$ through data lines associated with the area units $U_{j2}$, $U_{j3}$, . . . , and $U_{jM}$ of each area $A_j$, respectively.

39. The method of claim 38, wherein the voltage-transmittance functions, $\{T_j=F_j(V_j)\}$, j=1, 2, . . . , N, are identical or different from each other.

* * * * *